United States Patent [19]

Wolpoff

[11] 4,226,094

[45] Oct. 7, 1980

[54] FINGER RING

[76] Inventor: Sharon A. Wolpoff, 12000 Old Georgetown Rd., Rockville, Md. 20852

[21] Appl. No.: 913,410

[22] Filed: Jun. 7, 1978

[51] Int. Cl.[3] ..... A44C 9/00

[52] U.S. Cl. ..... 63/15.4

[58] Field of Search ..... 63/15, 15.6, 3, 15.1, 63/15.2, 15.3, 15.4

[56] References Cited

U.S. PATENT DOCUMENTS

| | | | |
|---|---|---|---|
| 613,243 | 11/1898 | Carroll et al. | 63/15.4 |
| 783,198 | 2/1905 | Hayes | 63/15.6 |
| 1,333,284 | 3/1920 | Schreiber | 63/15 UX |
| 1,822,392 | 9/1931 | Esterman | 63/15.4 |
| 2,408,982 | 10/1946 | Koenig | 63/15.3 X |
| 3,745,788 | 7/1973 | Sullivan | 63/15.6 |

FOREIGN PATENT DOCUMENTS

| | | | |
|---|---|---|---|
| 16559 | 2/1904 | Austria | 63/15.6 |
| 22616 | 1/1910 | Austria | 63/15.6 |
| 25697 | 2/1884 | Fed. Rep. of Germany | 63/15 |
| 518718 | 5/1921 | France | 63/15.4 |
| 759302 | 11/1933 | France | 63/15.6 |

*Primary Examiner*—F. Barry Shay

*Attorney, Agent, or Firm*—Leitner, Palan, Lyman, Martin & Bernstein

[57] ABSTRACT

A finger ring constructed of an inner annular section threadably attached to an outer annular section, the outer annular section being concentric with the inner section so that no portion of the inner peripheral surface of the outer section is in direct contact with the wearer's finger. Several threaded outer sections may be threadably attached to the inner section, with the outer sections being easily and quickly interchanged.

4 Claims, 4 Drawing Figures

FIG. 1
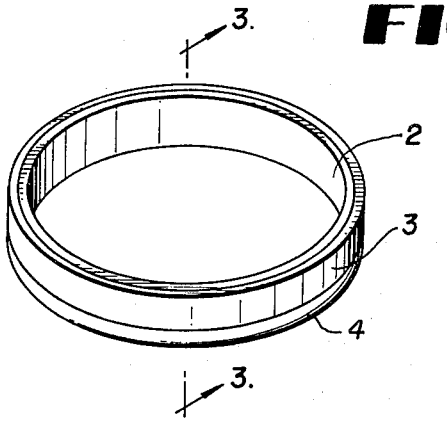
FIG. 2
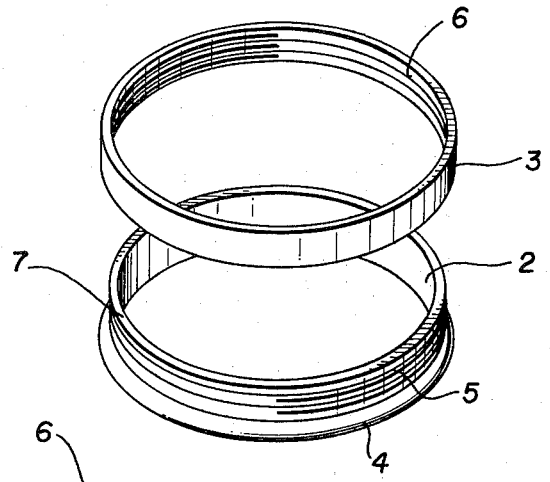
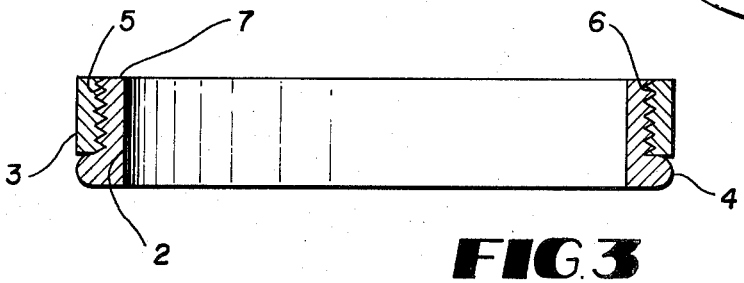
FIG. 3
FIG. 4
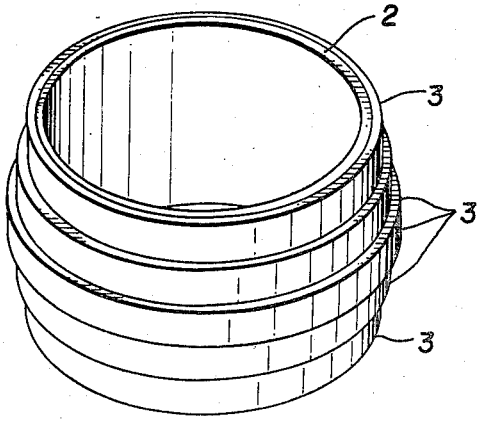

FINGER RING

BACKGROUND OF THE INVENTION

Finger rings are popular adornments, commercially available in a very large number of designs over a wide price range. Quality rings are generaly sized to custom fit the intended wearer. When a consumer selects a ring, his finger is measured and the ring diameter is then made smaller or larger to accommodate his finger size. This usually takes several days and the consumer is required to make at least two visits to the jeweler.

It is generally known that the human body reacts to certain materials, thus limiting the use of these materials in finger rings. Allergic reactions to ring materials is also a problem to some who wish to wear these adornments. Coating rings with non-reactive, non-allergenic materials is often economically not feasible.

A further area of commercial interest is ring versatility. There would be a commercial advantage if the design characteristics of a ring could be quickly and inexpensively changed by the wearer.

SUMMARY OF THE INVENTION

The present invention is directed to a unique finger ring structure. The finger ring is comprised of at least two sections. An inner annular section is provided with mounting threads extending over substantially its entire outer peripheral surface. This inner section acts as a base member onto which is threadably coupled one or more outer annular sections. The inner section, which may be in direct contact with the wearer's skin, may be made of a non-reactive, non-allergenic material. The outer annular sections are designed to be concentric with the inner section so that no part of the outer section is in direct contact with the wearer's skin, thus allowing the outer section to be constructed of any material without regard to its possible reaction with the wearer's skin.

Different inner sections may be made to have any of a number of different inside diameters while the outer diameter of each is maintained uniform. That is, a variety of inner sections can be manufactured having among them inner diameters corresponding to the different conventional ring sizes. The outer diameters of each would be the same to accommodate a standardized outer section diameter. A jeweler can stock a selection of inner sections having a variety of inner diameters to meet the needs of his customers. A variety of outer rings having different ornamental designs, each one of a group of outer rings being compatible with one of the inner sections would also be stocked. A customer could select a ring design and have a properly sized ring ready in a matter of moments by simply mounting the selected outer section to an inner section which properly fits his finger.

BRIEF DESCRIPTION OF THE DRAWINGS

FIG. 1 is a perspective view of the improved ring of the invention.

FIG. 2 is a perspective view of the inner and outer ring sections disconnected from each other.

FIG. 3 illustrates a section of the assembled ring of FIG. 1.

FIG. 4 is a perspective view of the assembled ring of the present invention with the inner section supporting a plurality of outer sections.

DESCRIPTION OF THE PREFERRED EMBODIMENTS

With reference to the figures, the improved ring of the present invention includes an inner annular section 2 and an outer annular section 3. A rim flange 4 may be integrally formed with the inner sector. The outer peripheral surface of the inner section is threaded as shown at 5. The inner peripheral surface of the outer annular section 3 is threaded as shown at 6. Threads 5 and 6 are complementary in that they are constructed so that the outer section 3 can be threadably mounted onto the inner section 2.

The thickness 7 of the inner section can be varied so that for a uniform outer diameter of the inner section, there may be any of a number of inner diameters. Therefore, the inner diameter of the inner section 2 can be made equivalent to any of the conventional ring sizes while the outer diameter is maintained uniform to accommodate a standardized outer section 3. The outer ring section 3, when mounted on the inner section, is concentric therewith so that no portion of the outer section is in contact with the wearer's skin. The inner and outer sections may be made from different materials. For example, the inner section 2 may be made from a non-reactive, non-allergenic material, thereby permitting people with sensitive skin to wear the ring. In addition, the outer section 3 may be made from relatively inexpensive material, making it economically feasible for consumer's to purchase a great variety of ring designs represented on the outer section 3. Since the outer section is quickly and easily disassembled from the inner section, a variety of outer sections can be quickly and easily interchanged. The rim flange 4 is preferable in that it acts as a stop for the outer section 3. The rim 4 also permits the outer section to be releasably locked to the inner section, preventing undesirable movement of the outer section when it has been mated with its inner section. However, the use of rim 4 is not mandatory.

A modification in the basic ring design is illustrated in FIG. 4 wherein a plurality of outer sections 3 are concentrically mounted about a single inner section 2. The outer sections may have a variety of outer diameters, as illustrated, which presents a most pleasing design. These outer sections can be readily interchanged, thus permitting the wearer to construct his own ring design.

There has been described a new and useful finger ring construction. This construction allows versatility. The inner section can be manufactured of non-allergenic materials thus permitting individuals with sensitive skin to be able to wear the ring without limiting the material with which the design portion of the ring is to be made. The outer section may be made from any material including inexpensive material so that individuals can purchase many different ring designs, all of which can be accommodated on a single quality base section. The inner sections can all be provided with a common uniform outer diameter to accommodate a standardized outer section. The inner diameters can be made variable to accommodate different ring sizes.

What is claimed:

1. A finger ring comprising an inner annular section and a plurality of at least three outer annular sections; said inner annular section provided with mounting threads extending over its outer peripheral surface; said outer annular sections having at least two different outer diameters relative to each other and each provided with mounting threads extending over its inner peripheral surface, the width of each outer annular section being substantially less than the width of the inner annular section such that when said outer annular sections are removably attached from an end of said inner annular section to form a composite outer structure comprising said plurality of outer annular sections in abutting relation, the total width of said outer annular section is equal to the width of said inner annular section such that the mounting threads of said inner annular section are covered and no portion of the inner peripheral surface of any of the said outer annular sections will be in direct contact with the wearer's finger.

2. A finger ring as claimed in claim 1 wherein said inner annular section is formed from a non-allergenic material.

3. A finger ring as claimed in claim 1 wherein said plurality of outer annular sections is of a material different from the material of the inner annular section.

4. A finger ring as claimed in claim 1 wherein at least one of said outer annular sections is provided with an ornamental design.

* * * * *